US009801522B2

(12) United States Patent
Wee et al.

(10) Patent No.: US 9,801,522 B2
(45) Date of Patent: Oct. 31, 2017

(54) DISH WASHER AND CONTROL METHOD THEREOF

(71) Applicant: SAMSUNG ELECTRONICS CO., LTD., Suwon-si, Gyeonggi-do (KR)

(72) Inventors: Jeon Suk Wee, Hwaseong-si (KR); Byung Sam Yoo, Bucheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 200 days.

(21) Appl. No.: 14/559,079

(22) Filed: Dec. 3, 2014

(65) Prior Publication Data

US 2015/0150430 A1 Jun. 4, 2015

(30) Foreign Application Priority Data

Dec. 4, 2013 (KR) ..... 10-2013-0149883

(51) Int. Cl.
*B08B 7/04* (2006.01)
*A47L 15/16* (2006.01)
*A47L 15/42* (2006.01)

(52) U.S. Cl.
CPC ..... *A47L 15/16* (2013.01); *A47L 15/4221* (2013.01)

(58) Field of Classification Search
None
See application file for complete search history.

(56) References Cited

U.S. PATENT DOCUMENTS 8,282,741 B2 * 10/2012 Bertsch ..... A47L 15/23 134/172
8,431,020 B2 * 4/2013 Straka ..... E04H 4/1281 210/167.11
2010/0043828 A1 * 2/2010 Choi ..... A47L 15/0005 134/18
2011/0132407 A1 * 6/2011 Fauth ..... A47L 15/0015 134/25.2
2012/0125382 A1 * 5/2012 Vanderroest ..... A47L 15/16 134/178

* cited by examiner

*Primary Examiner* — Binh X Tran
*Assistant Examiner* — David Cathey, Jr.
(74) *Attorney, Agent, or Firm* — Staas & Halsey LLP

(57) ABSTRACT

A dish washer including a sump unit disposed below a wash tub and configured to collect water, and an upper nozzle, a lower nozzle, and a subsidiary nozzle configured to spray water received from the sump unit onto dishes/cutlery contained in at least one rack. The sump unit includes a circulating pump configured to pump water collected in the sump unit, and a distributing element configured to allow water pumped by the circulating pump to be sprayed through any one of the lower nozzle and the subsidiary nozzle, and to be sprayed selectively through the upper nozzle. Accordingly, it is possible to independently perform an intensive wash mode of spraying water only through the subsidiary nozzle.

9 Claims, 7 Drawing Sheets

DISH WASHER AND CONTROL METHOD THEREOF

CROSS-REFERENCE TO RELATED APPLICATIONS

This application claims the benefit of Korean Patent Application No. 10-2013-0149883, filed on Dec. 4, 2013 in the Korean Intellectual Property Office, the disclosure of which is incorporated herein by reference.

BACKGROUND

1. Field

Embodiments of the present disclosure relate to a dish washer which includes a plurality of nozzles for spaying water to wash dishes/cutlery with water sprayed from the plurality of nozzles.

2. Description of the Related Art

In general, a dish washer includes a main body having a wash chamber inside, a rack unit arranged inside a wash tub and configured to contain dishes/cutlery therein, a plurality of nozzles configured to spray water onto the dishes/cutlery contained in the rack unit, and a sump unit located below the wash tub and configured to collect water used for washing and to supply the collected water to the nozzles.

The rack unit includes an upper rack and a lower rack arranged vertically. The nozzles include an upper nozzle disposed above the upper rack and configured to spray water onto dishes/cutlery contained in the upper rack, a lower nozzle disposed below the lower rack and configured to spray water onto dishes/cutlery contained in the lower rack, and a middle nozzle disposed between the upper rack and the lower rack and configured to simultaneously spray water onto the dishes/cutlery contained in the upper and lower racks.

SUMMARY

Therefore, it is an aspect of the present disclosure to provide a dish washer which is capable of selectively operating a lower nozzle.

Additional aspects of the disclosure will be set forth in part in the description which follows and, in part, will be obvious from the description, or may be learned by practice of the disclosure.

In accordance with one aspect of the present disclosure, a dish washer includes: a wash tub forming a wash chamber; at least one rack arranged in the wash chamber; a sump unit disposed below the wash tub and configured to collect water; a lower nozzle disposed below the at least one rack; an upper nozzle disposed above the at least one rack; a subsidiary nozzle configured to restrictively spray water to a predetermined area of the at least one rack; a circulating pump disposed in the sump unit and configured to pump water collected in the sump unit; and a distributing element disposed in the sump unit, and configured to enable water pumped by the circulating pump to be sprayed through any one of the lower nozzle and the subsidiary nozzle and to be sprayed selectively through the upper nozzle.

The sump unit may include a lower port to discharge water that is to be transferred to the lower nozzle, an upper port to discharge water that is to be transferred to the upper nozzle, and a subsidiary port to discharge water that is to be transferred to the subsidiary nozzle.

The lower port and the subsidiary port may be arranged with the upper port in between, and adjacent to the upper port in a circumferential direction, and the lower port and the subsidiary port may be spaced apart from each other in the circumferential direction.

The distributing element may include a distributing plate fabricated in the shape of a circular plate and rotatably installed, and the distributing plate may have a communicating hole that extends in the circumferential direction to correspond to both the upper port and any one of the lower port and the subsidiary port.

The distributing element may include a distributing motor having a shaft connected to the distributing plate and rotating the distributing plate, a cam coupled with the shaft of the distributing motor and rotating together with the shaft of the distributing motor, and a switch that is pressed selectively according to a rotation angle of the cam.

The circulating pump may include an impeller configured to rotate to move water collected in the sump unit, and a circulating motor configured to rotate the impeller.

The dish washer may further include: an upper passage connecting the upper nozzle to the upper port; a subsidiary passage connecting the subsidiary nozzle to the subsidiary port; and a lower passage connecting the sump unit to the lower nozzle, wherein the sump unit includes a connecting port to which the lower passage connects, and a connecting passage connecting the lower port to the connecting port.

The sump unit may include a sump housing provided with a water collecting part having a concave shape and configured to collect water, a sump cover configured to cover the upper part of the sump housing, and a filter frame disposed to cover the upper part of the sump cover and configured to support a filter, the sump cover may include the upper port, the lower port, and the subsidiary port, and the filter frame may include the connecting passage.

The at least one rack may include a lower rack positioned in a lower area of the wash chamber, and an upper rack positioned above the lower rack, the lower nozzle may be positioned below the lower rack, and the upper nozzle may be positioned above the upper rack.

The dish washer may further include a middle nozzle positioned between the upper rack and the lower rack.

In accordance with one aspect of the present disclosure, a control method of a dish washer controls the dish washer to operate in any one wash mode among wash modes of: a normal wash mode of spraying water simultaneously through an upper nozzle and a lower nozzle; a combined wash mode of spraying water through the upper nozzle and a subsidiary nozzle; an intensive wash mode of spraying water through the subsidiary nozzle; and a lower part wash mode of spraying water through the lower nozzle.

In the control method, the dish washer includes an upper port to discharge water that is to be transferred to the upper nozzle, a subsidiary port to discharge water that is to be transferred to the subsidiary nozzle, and a lower port to discharge water that is to be transferred to the lower nozzle, and conversion to the normal wash mode, the combined wash mode, the intensive wash mode, or the lower part wash mode is performed according to rotation of a distributing plate provided with a communicating hole.

In the normal wash mode, the distributing plate may rotate such that the communicating hole is at a position corresponding to both the upper port and the lower port.

In the combined wash mode, the distributing plate may rotate such that the communicating hole is at a position corresponding to both the upper port and the subsidiary port.

In the intensive wash mode, the distributing plate may rotate such that the communicating hole is at a position corresponding to the subsidiary port.

In the lower part wash mode, the distributing plate may rotate such that the communicating hole is at a position corresponding to the lower port.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
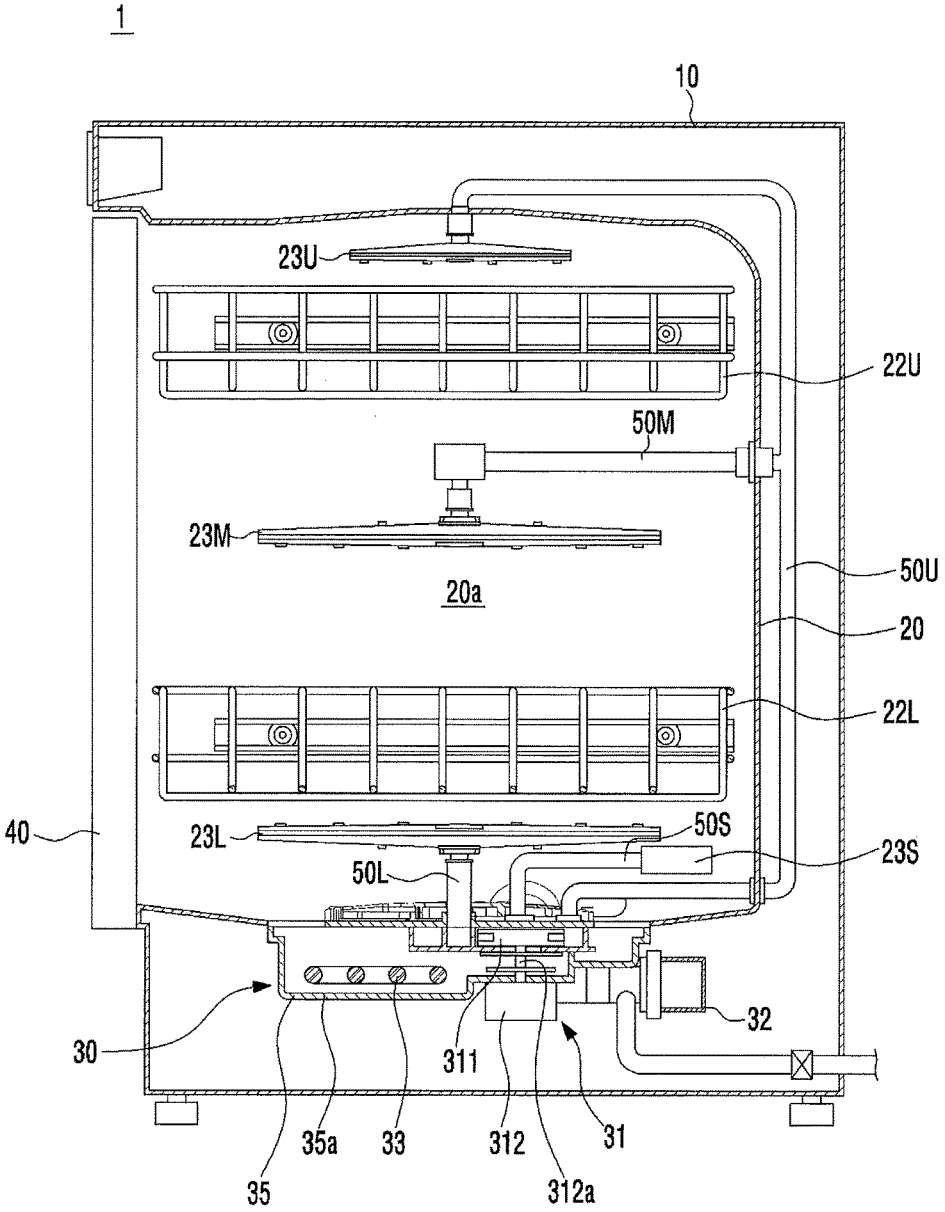
FIG. 1 is a cross-sectional view of a dish washer according to an embodiment of the present disclosure.

Reference will now be made in detail to the embodiments of the present disclosure, examples of which are illustrated in the accompanying drawings, wherein like reference numerals refer to like elements throughout.

Hereinafter, a dish washer according to an embodiment of the present disclosure will be described with reference to the accompanying drawings.

As shown in FIG. 1, a dish washer 1 according to an embodiment of the present disclosure may include: a main body 10 forming an external appearance; a wash tub 20 forming a wash chamber 20*a* housed inside the main body 10 and configured to wash dishes/cutlery; a sump unit 30 disposed below the wash tub 20 and configured to collect water used for washing; and a door 40 configured to open and close the opened front part of the wash tub 20.

In the wash tub 20, a plurality of racks may be arranged vertically and configured to respectively contain dishes/cutlery therein, and a plurality of nozzles configured to spray water received through the sump unit 30 onto the dishes/cutlery contained in the plurality of racks may be arranged. While any number of racks may be used depending on the configuration of the dish washer 1, the disclosure will describe a pair of racks as being disposed within the wash tub 20.

The pair of racks may include an upper rack 22U positioned in the upper area of the wash chamber 20*a* and a lower rack 22L positioned in the lower area of the wash chamber 20*a*.

The plurality of nozzles may include any number of nozzles depending on the configuration of the dish washer 1. For example, the plurality of nozzles may include an upper nozzle 23U positioned above the upper rack 22U and configured to spray washing water downward, a lower nozzle 23L positioned below the lower rack 22L and configured to spray washing water upward, a middle nozzle 23M positioned between the upper rack 22U and the lower rack 22L and configured to spray washing water downward and upward, and a subsidiary nozzle 23S positioned to the left or right of the lower area of the wash chamber 20*a* and configured to spray water restrictively to a predetermined area of the lower rack 22L.

The upper nozzle 23U may spray water downward to wash dishes/cutlery contained in the upper rack 22U, and the lower nozzle 23L may spray water upward to wash dishes/cutlery contained in the lower rack 22L. Also, the middle nozzle 23M may spray water upward and downward to simultaneously wash the dishes/cutlery contained in the upper and lower racks 22U and 22L. The subsidiary nozzle 23S, which sprays water restrictively to a predetermined area of the lower rack 22L, may be designed to spray water at relatively higher pressure than the other nozzles 23U, 23M, and 23L so as to intensively wash heavily dirty dishes/cutlery in the predetermined area.

The sump unit 30 may be positioned at the center of the bottom of the wash tube 20, and act to collect washing water that is used for washing.

Figure 2:
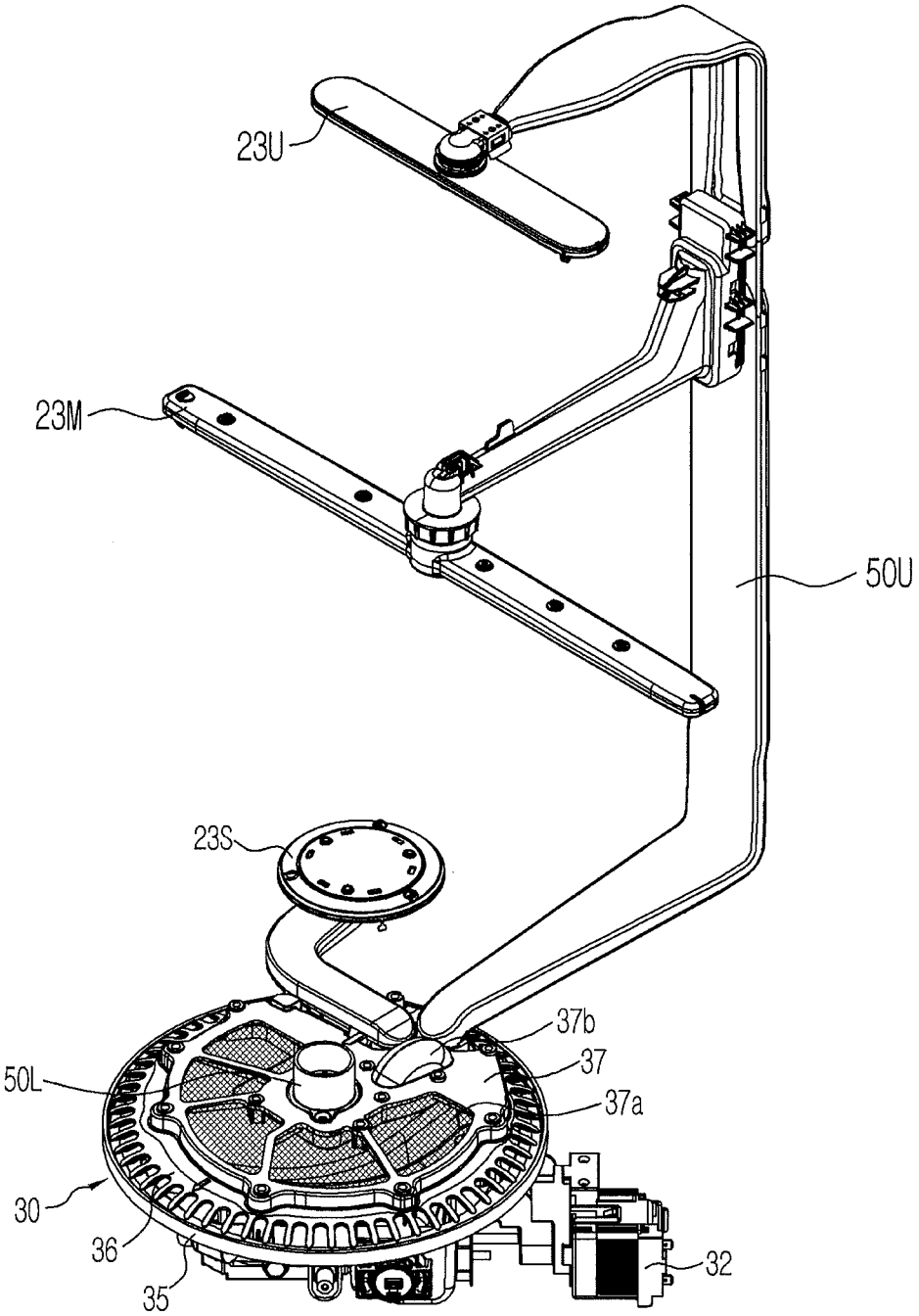
FIG. 2 is a perspective view showing an arrangement of a sump unit and nozzles in a dish washer according to an embodiment of the present disclosure.
Figure 3:
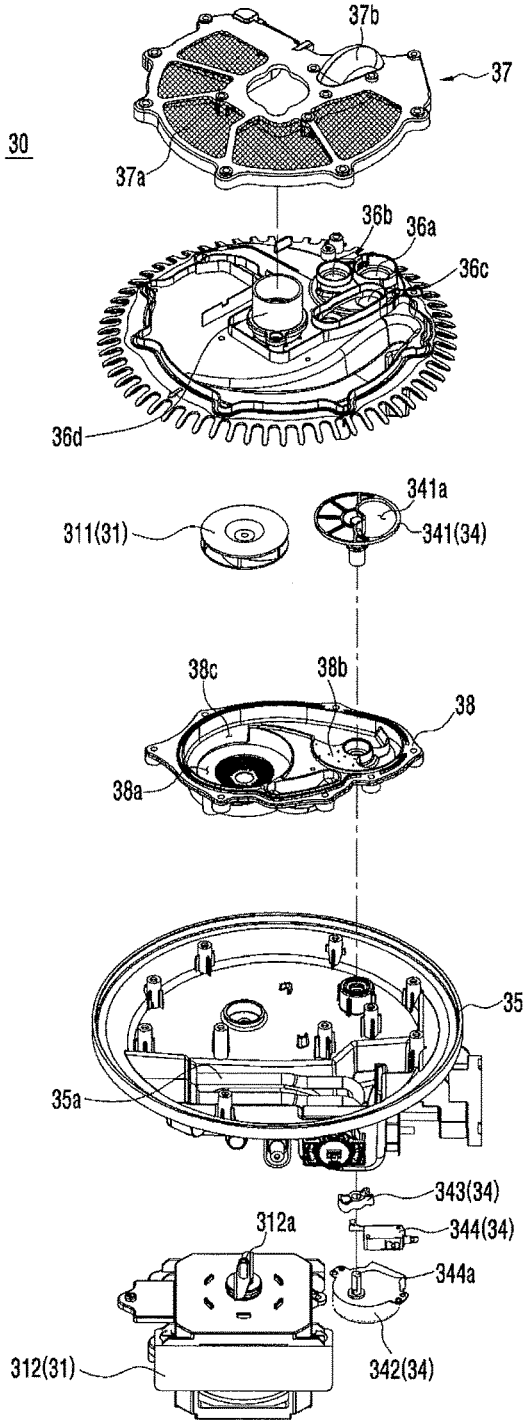
FIG. 3 is an exploded perspective view of a sump unit in a dish washer according to an embodiment of the present disclosure.

As shown in FIGS. 2 and 3, the sump unit 30 may include: a circulating pump 31 configured to pump washing water collected in the sump unit 30 and to circulate the washing water; a drainage pump 32 configured to drain, after washing is completed, water used for washing to the outside; a heater 33 configured to heat the water collected in the sump unit 30; and a distributing element 34 to transfer water discharged from the circulating pump 31 to the respective nozzles 23U, 23M, 23L, and 23S, selectively.

The sump unit 30 may further include: a sump housing 35 provided with a water collecting part 35*a* having a downwardly concave shape and configured to collect water; a sump cover 36 configured to cover the upper part of the sump housing 35; a filter frame 37 configured to support a mesh filter 37*a* that is disposed above the sump cover 36 to filter out foreign materials contained in water; and a circulating housing 38 coupled with the lower part of the sump cover 36 and configured to accommodate an impeller 311 and a distributing plate 341 which will be described later.

The circulating pump 31 may include the impeller 311 disposed at one side inside the circulating housing 38 and configured to rotate to pump and move water, and a circulating motor 312 disposed below the sump housing 35, a shaft 312*a* of the circulating motor 312 connected to the impeller 311 to rotate the impeller 311.

The drainage pump 32 may connect to the water collecting part 35*a*, and drain water collected in the water collecting part 35*a* to the outside.

The heater 33 may be placed in the water collecting part 35*a* of the sump housing 35 to heat water collected in the water collecting part 35*a* so that the heated water can be used for washing.

The sump cover 36 may include a plurality of ports which discharge water to the plurality of nozzles. For example, the sump cover 36 may include an upper port 36*a* to discharge water that is to be transferred to the upper nozzle 23U, a lower port 36*c* to discharge water that is to be transferred to the lower nozzle 23L, and a subsidiary port 36*b* to discharge water that is to be transferred to the subsidiary nozzle 23S. In the current embodiment, the lower port 36*c* and the subsidiary port 36*b* may be adjacent to each other with the upper port 36*a* in between, and spaced apart from each other in a circumferential direction.

Meanwhile, inside the wash tube 20, as shown in FIG. 1, is disposed a water passage system. The water passage system may include an upper passage 50U whose one end connects to the upper port 36*a* and whose other end connects to the upper nozzle 23U so as to guide water discharged from the upper port 36*a* to the upper nozzle 23U, a lower passage 50L whose one end connects to the sump unit 30 and whose other end connects to the lower nozzle 23L so as to guide water discharged from the circulating pump 31 to the lower nozzle 23L, a subsidiary passage 50S whose one end connects to the sump unit 30 and whose other end connects to the subsidiary port 36*b* so as to guide water discharged from the circulating pump 31 to the subsidiary nozzle 23S, and a middle passage 50M connecting the upper passage 50U to the middle nozzle 23M to guide a part of water passing through the upper passage 50U to the middle nozzle 23M may be provided.

Also, the sump cover 36 may include a connecting port 36*d* to which the lower end of the lower passage 50L connects, and the filter frame 37 may include a connection passage 37*b* to guide water discharged from the lower port 36*c* to the connecting port 36*d*, so that water discharged through the lower port 36*c* is sprayed from the lower nozzle 23L via the connection passage 37*b*, the connecting port 36*d*, and the lower passage 50L.

The distributing element 34 may include a distributing plate 341 fabricated in the shape of a circular plate and rotatably installed at the other side inside the circulating housing 38, a distributing motor 342 having a shaft 344*a* connected to the center of the distributing plate 341 and rotating the distributing plate 341, a cam 343 coupled with the shaft 344*a* of the distributing motor 342, and a switch 344 that is pressed selectively according to a rotation angle of the cam 343.

The distributing plate 341 may have a communicating hole 341*a* to allow water discharged from the impeller 311 to pass through the distributing plate 341 and to be discharged through at least one of the upper port 36*a*, the lower port 36*c*, and the subsidiary port 36*b*. In the current embodiment, the communicating hole 341*a* may extend in the circumferential direction to correspond to both the upper port 36 and any one of the lower port 36*c* and the subsidiary port 36*b*. However, the communication hole 341*a* may be arranged differently according to other arrangements of the dish washer 1.

Accordingly, as the distributing plate 341 rotates, the communicating hole 341*a* provided in the distributing plate 341 may move to a position corresponding to both the upper port 36*a* and the lower port 36*c*, to a position corresponding to both the upper port 36*a* and the subsidiary port 36*b*, a position corresponding to the subsidiary port 36*b*, and a position corresponding to the lower port 36*c*, sequentially. At this time, the rotation angle of the distributing plate 341 may be sensed according to whether the switch 344 has been pressed by the cam 343. Accordingly, it is possible to rotate the distributing plate 341 such that the communicating hole 341*a* corresponds to at least one of the upper port 36*a*, the lower port 36*c*, and the subsidiary port 36*b*.

The circulating housing 38 may be coupled with the lower part of the sump cover 36. The circulating housing 38 may include an impeller accommodating part 38*a* in which the impeller 311 is rotatably installed, a distributing plate accommodating part 38*b* in which the distributing plate 341 is rotatably installed, and a guide passage 38*c* to guide water from the impeller accommodating part 38*a* to the distributing plate accommodating part 38*b*.

Now, operations of the dish washer 1 according to the current embodiment configured as described above will be described.

Figure 4:
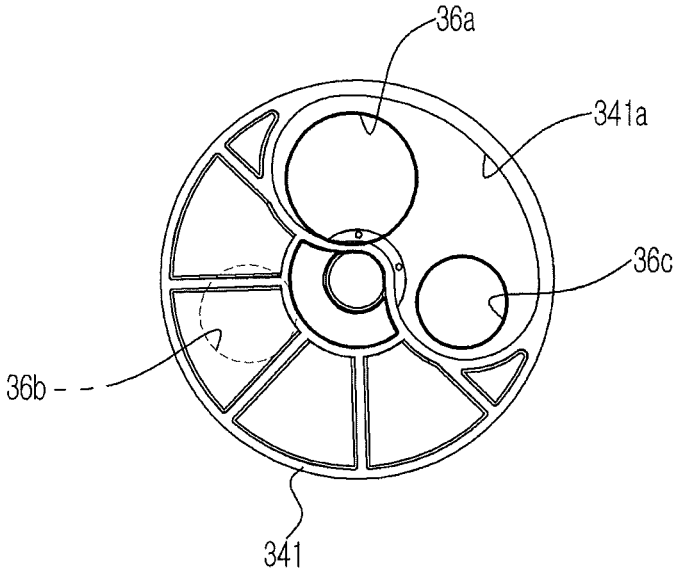
FIG. 4 shows a position of a distributing plate in a normal wash mode, in a dish washer according to an embodiment of the present disclosure.

Referring to FIG. 4, when the distributing plate 341 is rotated by the distributing motor 342 so that the communicating hole 341*a* of the distributing plate 341 moves to the position corresponding to both the upper port 36*a* and the lower port 36*c*, water may pass through the upper port 36*a* and the upper passage 50U sequentially to be transferred to the upper nozzle 23U and sprayed onto dishes/cutlery contained in the upper rack 22U through the upper nozzle 23U, thus washing the dishes/cutlery contained in the upper rack 22U. At this time, a part of water passing through the upper passage 50U may be transferred to the middle nozzle 23M through the middle passage 50M, and then sprayed onto dishes/cutlery contained in the upper rack 22 and the lower rack 22L through the middle nozzle 23M, thus simultaneously washing the dishes/cutlery contained in the upper rack 22 and the lower rack 22L.

Also, water may pass through the lower port 36*c*, the connecting passage 37*b*, the connecting port 36*d*, and the lower passage 50L, sequentially, to be transferred to the lower nozzle 23L, and then sprayed onto dishes/cutlery contained in the lower rack 22L through the lower nozzle 23L, thus washing the dishes/cutlery contained in the lower rack 22L.

Accordingly, the dish washer 1 may operate in a normal wash mode of washing all dishes/cutlery contained in the upper rack 22U and the lower rack 22L.

Figure 5:
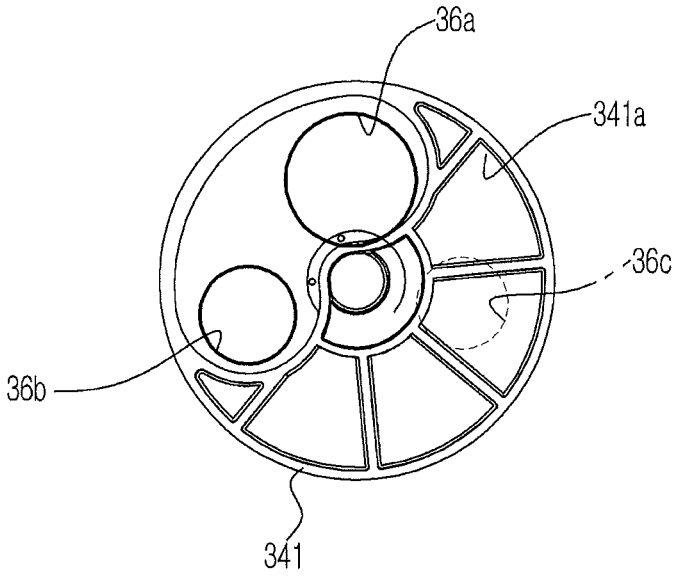
FIG. 5 shows a position of a distributing plate in a combined wash mode, in a dish washer according to an embodiment of the present disclosure.

Referring to FIG. 5, when the distributing plate 341 is rotated by the distributing motor 342 so that the communicating hole 341*a* of the distributing plate 341 moves to the position corresponding to both the upper port 36*a* and the subsidiary port 36*b*, water may pass through the upper port 36*a* and the upper passage 50U sequentially to be transferred to the upper nozzle 23U and then sprayed onto dishes/cutlery contained in the upper rack 22U through the upper nozzle 23U, thus washing the dishes/cutlery contained in the upper rack 22U. At this time, a part of water passing through the upper passage 50U may be transferred to the middle nozzle 23M through the middle passage 50M, and then sprayed onto dishes/cutlery contained in the upper rack 22 and the lower rack 22L through the middle nozzle 23M, thus simultaneously washing the dishes/cutlery contained in the upper rack 22 and the lower rack 22L.

Also, water may pass through the subsidiary port 36*b* and the subsidiary passage 50S sequentially to be transferred to the subsidiary nozzle 23S and then sprayed onto dishes/cutlery contained in a predetermined area of the lower rack 22L through the subsidiary nozzle 23S, thus restrictively washing only the dishes/cutlery contained in the predetermined area.

Since the subsidiary nozzle 23S is designed to spray water at relatively higher pressure than the other nozzles 23U, 23M, and 23L, heavily dirty dishes/cutlery may be intensively washed in the predetermined area of the lower rack 22L.

That is, the dish washer 1 may operate in a combined wash mode of performing normal washing in the upper rack 22U and performing intensive washing in the lower rack 22L.

Figure 6:
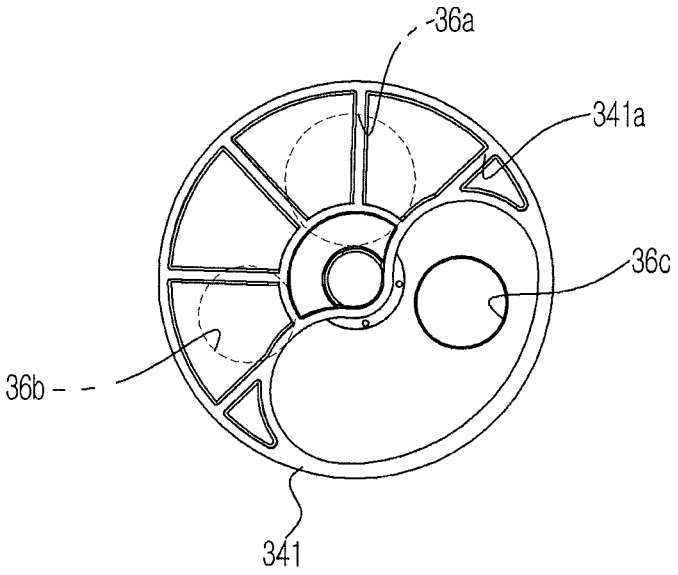
FIG. 6 shows a position of a distributing plate in an intensive wash mode, in a dish washer according to an embodiment of the present disclosure.

Referring to FIG. 6, when the distributing plate 341 is rotated by the distributing motor 342 so that the communicating hole 341*a* of the distributing plate 341 moves to the position corresponding to the subsidiary port 36*b*, water may pass through the subsidiary port 36*b* and the subsidiary passage 50S sequentially to be transferred to the subsidiary nozzle 23S and then sprayed onto dishes/cutlery contained in a predetermined area of the lower rack 22L through the subsidiary nozzle 23S, thus restrictively washing only the dishes/cutlery contained in the predetermined area of the lower rack 22L. Since the subsidiary nozzle 23S is designed to spray water at relatively higher pressure than the other nozzles 23U, 23M, and 23L, intensive washing may be performed in the predetermined area of the lower rack 22L.

Accordingly, the dish washer 1 may operate in an intensive wash mode.

Figure 7:
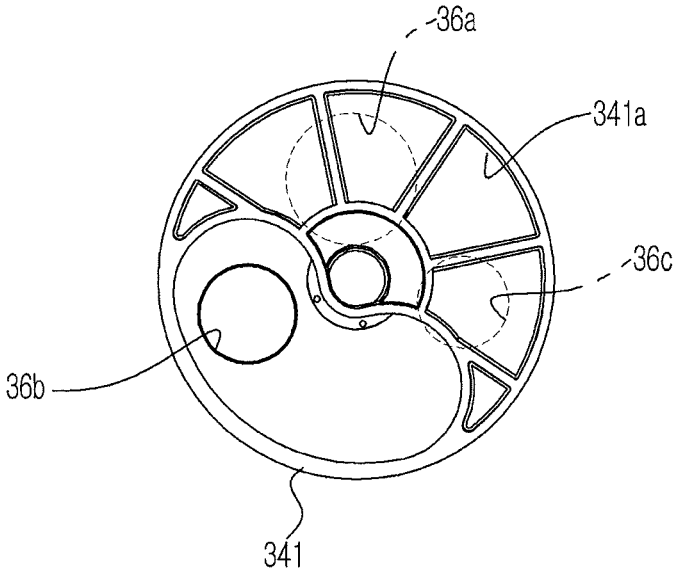
FIG. 7 shows a position of a distributing plate in a lower part wash mode, in a dish washer according to an embodiment of the present disclosure.

Referring to FIG. 7, when the distributing plate 341 is rotated by the distributing motor 342 so that the communicating hole 341*a* of the distributing plate 341 moves to the position corresponding to the lower port 36*c*, water may pass through the lower port 36*c*, the connecting passage 37*b*, the connecting port 36*d*, and the lower passage 50L sequentially to be transferred to the lower nozzle 23L and then sprayed onto dishes/cutlery contained in the lower rack 22L through the lower nozzle 23L, thus washing the dishes/cutlery contained in the lower rack 22L.

Accordingly, the dish washer 1 may operate in a lower part wash mode of washing only dishes/cutlery contained in the lower rack 22L.

As described above, the dish washer 1 according to the current embodiment can transfer water selectively to the lower nozzle 23L through the distributing element 34, thereby independently performing the intensive wash mode and the lower part wash mode.

Also, the dish washer 1 can transfer water selectively to the lower nozzle 23L, thereby independently performing the intensive wash mode of spraying water only through the subsidiary nozzle 23S.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dish washer comprising:

a wash tub forming a wash chamber;

at least one rack arranged in the wash chamber;

a lower nozzle disposed below the at least one rack;

an upper nozzle disposed above the at least one rack;

a subsidiary nozzle configured to spray water at a higher pressure than a pressure of the lower nozzle and a pressure of the upper nozzle towards a predetermined area of the at least one rack;

a sump unit disposed below the wash tub and configured to collect water, the sump unit including a lower port to discharge water that is to be transferred to the lower nozzle, an upper port to discharge water that is to be transferred to the upper nozzle, and a subsidiary port to discharge water that is to be transferred to the subsidiary nozzle;

a circulating pump disposed in the sump unit and configured to pump water collected in the sump unit; and a distributing element disposed in the sump unit configured to distribute water pumped by the circulating pump to any one of the lower nozzle, the upper nozzle and the subsidiary nozzle, the distributing element comprising a rotatably installed distributing plate fabricated in the shape of a circular plate and having a communicating hole that extends in a circumferential direction to correspond to both the upper port and any one of the lower port and the subsidiary port.

2. The dish washer according to claim 1, wherein the lower port and the subsidiary port are arranged with the upper port in between, and adjacent to the upper port in a circumferential direction, and the lower port and the subsidiary port are spaced apart from each other in the circumferential direction.

3. The dish washer according to claim 2, wherein the distributing element further comprises a distributing motor having a shaft connected to the distributing plate and rotating the distributing plate, a cam coupled with the shaft of the distributing motor and rotating together with the shaft of the distributing motor, and a switch that is pressed selectively according to a rotation angle of the cam.

4. The dish washer according to claim 2, wherein the circulating pump comprises an impeller configured to rotate to move water collected in the sump unit, and a circulating motor configured to rotate the impeller.

5. The dish washer according to claim 2, further comprising:

an upper passage connecting the upper nozzle to the upper port;

a subsidiary passage connecting the subsidiary nozzle to the subsidiary port; and a lower passage connecting the sump unit to the lower nozzle, wherein the sump unit comprises a connecting port to which the lower passage connects, and a connecting passage connecting the lower port to the connecting port.

6. The dish washer according to claim 5, wherein:

the sump unit further comprises a sump housing provided with a water collecting part having a concave shape and configured to collect water, a sump cover configured to cover the upper part of the sump housing, and a filter frame disposed to cover the upper part of the sump cover and configured to support a filter, the sump cover comprises the upper port, the lower port, and the subsidiary port, and the filter frame comprises the connecting passage.

7. The dish washer according to claim 1, wherein the at least one rack comprises a lower rack positioned in a lower area of the wash chamber, and an upper rack positioned above the lower rack, and the lower nozzle is positioned below the lower rack, and the upper nozzle is positioned above the upper rack.

8. The dish washer according to claim 7, further comprising a middle nozzle positioned between the upper rack and the lower rack.

9. A dish washer comprising:

a wash tub forming a wash chamber;

a rack to hold dishes arranged in the wash chamber;

a lower nozzle disposed below the rack to spray water upwards towards the rack;

an upper nozzle disposed above the rack to spray water downwards towards the rack;

a subsidiary nozzle disposed below the rack and to one side of the rack to spray water upwards towards the one side of the rack, the subsidiary nozzle being configured to spray water at a higher pressure than a pressure of the lower nozzle and a pressure of the upper nozzle;

a circulating pump to pump water to the lower nozzle, the upper nozzle and the subsidiary nozzle; and a distributing element to distribute water pumped by the circulating pump to any one of the lower nozzle, the upper nozzle and the subsidiary nozzle, the distributing element comprising a rotatably installed distributing plate fabricated in the shape of a circular plate and having a communicating hole that extends in a circumferential direction to correspond to both an upper port leading to the upper nozzle and any one of a lower port leading to the lower nozzle and a subsidiary port leading to the subsidiary port.

* * * * *